US012084153B2

(12) United States Patent
McNaughton

(10) Patent No.: US 12,084,153 B2
(45) Date of Patent: Sep. 10, 2024

(54) PORTABLE STRUCTURAL SEAT STEP

(71) Applicant: Patrick McNaughton, Plymouth, MN (US)

(72) Inventor: Patrick McNaughton, Plymouth, MN (US)

( * ) Notice: Subject to any disclaimer, the term of this patent is extended or adjusted under 35 U.S.C. 154(b) by 954 days.

(21) Appl. No.: 17/067,385

(22) Filed: Oct. 9, 2020

(65) Prior Publication Data

US 2021/0107597 A1 Apr. 15, 2021

Related U.S. Application Data

(60) Provisional application No. 62/914,092, filed on Oct. 11, 2019.

(51) Int. Cl.

| | |
|---|---|
| ***B63B 3/48*** | (2006.01) |
| *A47C 7/24* | (2006.01) |
| *B63B 29/04* | (2006.01) |

(52) U.S. Cl.

CPC ..... *B63B 3/48* (2013.01); *A47C 7/24* (2013.01); *B63B 29/04* (2013.01); *B63B 2029/043* (2013.01)

(58) Field of Classification Search

CPC ..... B63B 3/48; B63B 29/04; B63B 2029/043; A47C 7/24; B63C 9/30; B32B 3/10; B32B 3/16; B32B 3/18

See application file for complete search history.

(56) References Cited

U.S. PATENT DOCUMENTS

| | | | | |
|---|---|---|---|---|
| 4,361,614 | A * | 11/1982 | Moffitt, Jr. | A47G 27/0212 428/44 |
| 5,346,759 | A * | 9/1994 | Will | B63B 3/48 428/323 |
| 2006/0228537 | A1* | 10/2006 | Cheung | B32B 27/065 428/318.4 |
| 2008/0026197 | A1* | 1/2008 | Cheung | B32B 5/18 428/215 |
| 2008/0190350 | A1* | 8/2008 | Giannasca | F16F 15/08 114/363 |
| 2013/0280475 | A1* | 10/2013 | Champion | B63B 3/68 29/428 |
| 2014/0004322 | A1* | 1/2014 | Kim | B32B 38/04 156/256 |
| 2014/0069337 | A1* | 3/2014 | Dunford | A01K 1/0157 119/28.5 |
| 2016/0229491 | A1* | 8/2016 | Brewer | B32B 3/04 |
| 2017/0120557 | A1* | 5/2017 | Pickren | B32B 37/182 |
| 2019/0263482 | A1* | 8/2019 | Neese | B60N 2/3034 |

* cited by examiner

*Primary Examiner* — Brian Handville
(74) *Attorney, Agent, or Firm* — Skaar Ulbrich Macari, P.A.

(57) ABSTRACT

A lightweight and portable seat step includes a series of laminated flexible layers with a void defined inside of a middle flexible layer to accommodate a thin but very stiff or rigid sheet of material as compared to the flexible layers. The stiff sheet is surrounded by the remainder of the flexible material of the layer that forms a flexible perimeter and the adjacent layers of material. Together, the flexible layers and stiff sheet function as a monolithic body.

16 Claims, 9 Drawing Sheets

PORTABLE STRUCTURAL SEAT STEP

PRIORITY

This application claims the priority benefit of U.S. Provisional Application No. 62/914,092, filed on Oct. 11, 2019, which is hereby incorporated herein by reference in its entirety.

FIELD

The present invention relates to upholstered surfaces, and more particularly, to a portable seat step for use with boat seats and other similar applications.

BACKGROUND

Premature wear of upholstered seat cushions that are used as a step can occur due to a concentrated load applied to a relatively small area of the seat surface. When there is a concentrated load on a small area of a seat cushion, the underlying foam inside the seat's upholstery compresses. This compression creates a dent. The outer membrane of the upholstery must stretch to accommodate this misshapen cushion. The fabric and vinyl are designed to stretch, however the holes in the fabric as a result of stitching are more vulnerable to wear and tear when stretched. Seat cushions have multiple panels in their construction including embroidery. All these areas are very vulnerable to early wear, and ultimately to tearing.

Boats are a very common place for seat stress damage to occur because the seat material is already subject to premature aging and loss of elasticity due to exposure to ultraviolet radiation from the sun and exposure to freeze/thaw, rain and other contaminants.

If a boat is on a trailer, lift, or even in the water at a dock, climbing in and out of the boat usually involves stepping on a seat cushion to make it easier to transition over the side of the boat and down to a floor that is on a different horizontal plane above or below.

Boats that are designed to be used for water sports like skiing, wakeboarding, inner tubing and surfing, to name a few, encourage the sport participant to enter and exit the water at the stern of the boat. A common interior in these boats features a seat that goes port to starboard along the back of the boat's cockpit. Another common condition on recreational boats is a padded deck area going port to starboard along the stern of the boat. This deck area covers engines and provides a larger area for one to lay on or sit in the sun when the boat is stationary. This back seat and back pad area are typically upholstered cushions. Every time a swimmer or water sport participant uses the back of the boat to access the water, they use the seat cushion as a step to get up to the aft padded area. They also walk across the padded deck to reach the stern of the boat. Both the seat cushion and back padded area in this case have stitched seams and panels to construct their shape. All these seams are vulnerable to pre-mature wear. It is quite common for boats that are only a couple years old to have their stitching and seams separate in these high traffic areas. In boats that are a little older many of their cushions have torn. Torn seats are costly to reupholster.

The problem is so pervasive that some boat manufacturers are deleting the center back seat and replacing it with an actual step. This is unpopular with many boaters because it has permanently eliminated the space for a person to sit. This makes the other seating areas more crowded and reduces the number of possible passengers in the boat.

Boaters often place towels on seats, and even double them up, but this still does not prevent the seat's membrane from stretching and putting pressure on the seams.

The use of a common household or garage mat made of carpet or rubber laid atop the boat seat does not adequately remedy the seat damage issue. It is not effective because such mats have little or no internal structure, so it protects the surface of the upholstery only. The deflection (dent) in the cushion is nearly the same as without it. Stretch and tearing will still occur.

There is a product that is a vinyl bag like a pillowcase with a flat plastic sheet inside and that is sewn on its end. The plastic sheet is loose inside the case such that it can move or float around. The sheet material is still quite flexible and brittle at the same time, causing it to fracture or fold when a concentrated load is applied. Other than the towels above, when water or moisture is present the seat surfaces can be slippery, and the mat can move, making it an unsafe step.

Therefore, there is a continuing need to address the seat damage resulting from use as a step or application of a concentrated load.

SUMMARY

The present invention addresses the drawbacks and weaknesses of the prior art by providing a lightweight portable step that can be placed atop the boat seat surface. The seat step includes a series of laminated flexible layers with a void defined inside of a middle flexible layer to accommodate a thin but very stiff or rigid sheet of material as compared to the flexible layers. The stiff sheet is surrounded by the remainder of the flexible material of the layer that forms a flexible perimeter and the adjacent layers of material. Together, the flexible layers and stiff sheet function as a monolithic body. Additional features, aspects and advantages of the invention will be discussed herein below and in the Detailed Description section.

The disclosure includes a portable step comprising a first layer of flexible material, a second layer of flexible material and a third layer. The third layer is disposed vertically atop the first layer and vertically below the second layer. The third layer comprises a rigid sheet and a perimeter of flexible material that surrounds the entirety of a horizontal perimeter of the rigid sheet the rigid sheet.

The first, second and third layers can be horizontally co-extensive such that the portable step defines a horizontally-extending planar body. The first and second layers can be formed of a material that causes the portable step to float on water. A waterproof adhesive can be used to join the first layer to the third layer and the second layer to the third layer. The first layer on a side thereof opposite the third layer can have a non-skid property.

The first layer can comprise a first sub-layer and a second sub-layer, wherein the first sub-layer faces opposite the second layer, and wherein the first sublayer defines a plurality of channels therein to reveal the second sub-layer where the plurality of channels are formed. The second sub-layer can have a different color than the first sub-layer. A relief groove can be defined in the first layer vertically above the perimeter of flexible material of the third layer.

The rigid sheet can define radiused corners.

The first layer on a side thereof opposite the third layer can be textured.

The rigid sheet can be pre-loaded such that in an unladen state the rigid sheet defines an vertically-upward curvature.

In top view, the portable step can define a polygon shape, such as for example, square, rectangle, hexagonal, etc.

A plurality of apertures can be defined through each of the first, second and third layers of the portable step such that water introduced to a top surface of the portable step can drain vertically through the plurality of apertures.

One or more horizontal sides of the portable step can comprise a vertical extension portion. The vertical extension portion can comprise an internal stiffener. The vertical extension portion can be pivotable with respect to the first, second and third layers.

The disclosure also includes a method of protecting an upholstered surface of a boat from persons stepping on the upholstered surface. The method includes placing a portable step on a portion of the upholstered surface of the boat where persons are likely to enter or exit the boat. The portable step includes a rigid sheet of material enclosed in a flexible material, wherein a horizontal width of the flexible material is wider than a horizontal width of the rigid sheet of material. Persons step onto the portable step, thereby causing the rigid sheet of material to distribute a stepping force of the person across the rigid sheet and causing the flexible material horizontally-outside of the horizontal width of the rigid sheet of material to flex in response to the stepping force.

The step of placing the portable step on the upholstered surface of the boat can include placing the portable step across a gap between two adjacent seat cushions of the boat.

Water can be drained from a top surface of the portable step through apertures defined vertically through the portable step.

The portable step can be secured in place by disposing a vertical extension of the portable step in a gap between a pair of adjacent cushions of the boat.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

DETAILED DESCRIPTION

Figure 1:
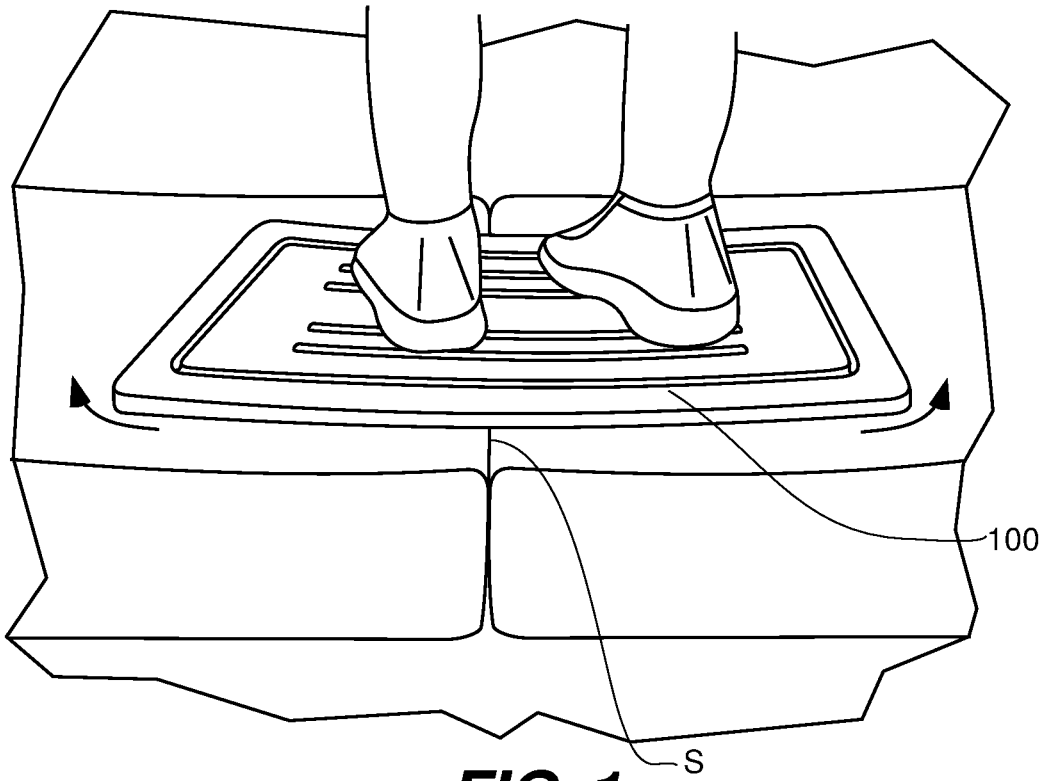
FIG. 1 is an illustration of an embodiment of the invention disposed atop a boat seat and a person standing on the invention.
Figure 2:
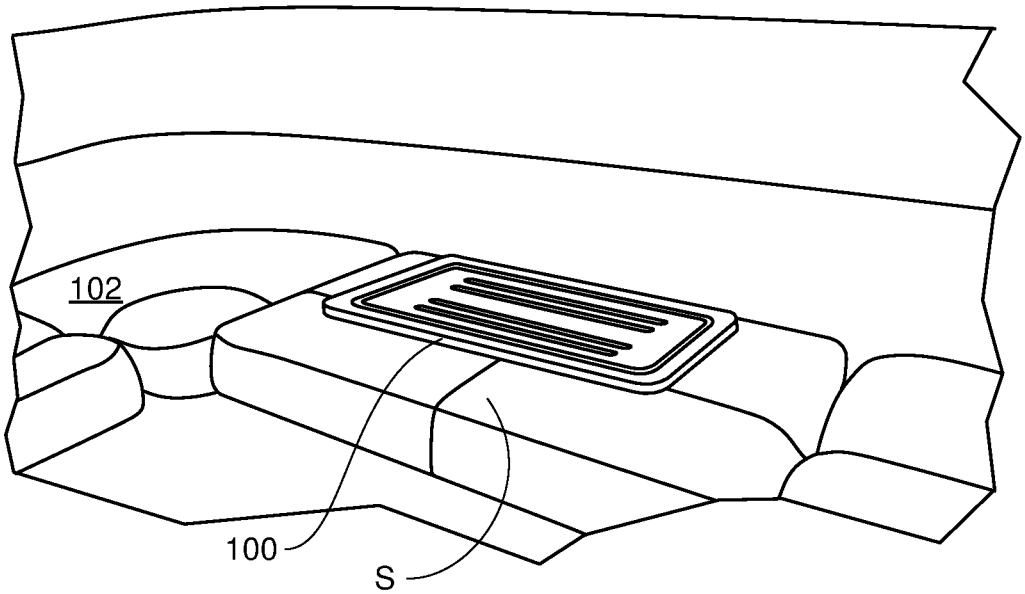
FIG. 2 is an image of an embodiment of the invention disposed atop a boat seat.
Figure 3B:
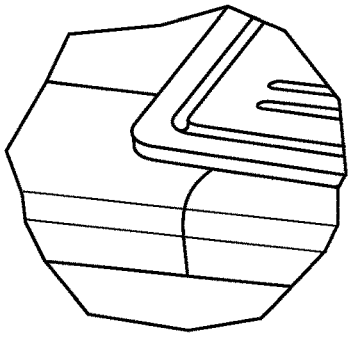
FIG. 3B is an enlargement of a portion of FIG. 3A.
Figure 3A:
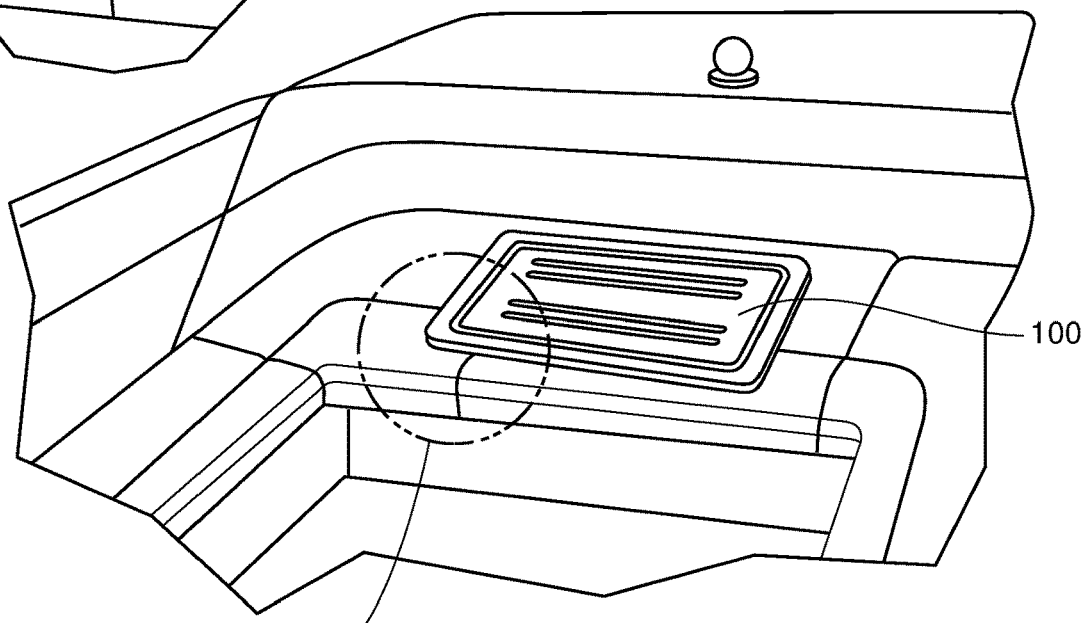
FIG. 3A is an illustration of an embodiment of the invention disposed atop a boat seat.

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention. The invention is to cover all modifications, equivalents, and alternatives falling within the scope of the invention as defined by the appended claims.

The various features or aspects discussed herein can also be combined in additional combinations and embodiments, whether or not explicitly discussed herein, without departing from the scope of the invention.

Referring generally to FIGS. 1-16C, a seat step 100 comprises a series of laminated flexible layers 102, 104 and 106. These layers can be formed, for example, of ethylene-vinyl acetate (EVA) or poly (ethylene-vinyl acetate) (PEVA). This material also will allow the seat step 100 to float on water, so the seat step can be easily retrieved if it accidentally falls into the water.

A void 108 is defined inside a middle flexible layer 104 to accommodate a thin but very stiff (rigid) sheet of material (epoxy plate) 110 as compared to the flexible layers 102 and 106. The thickness of this stiff sheet or plate 110 is very similar to the thickness of the void 108 (and of the layer defining the void). The stiff sheet 110 is surrounded by the remainder of the flexible material of the layer 104 that forms a flexible perimeter.

The stiff sheet 110 is adhered to the adjacent flexible layers 102, 106 above and below with a very strong waterproof permanent adhesive. This configuration provides a stiffening means inside the product that is undetectable to eye of the user and that is not exposed to the environment. There is no impression embossed or debossed on any surface to the product to reveal the presence of the stiff sheet 110.

In one example embodiment, the seat step 100 is formed from a minimum of 3 layers of a flexible foam 102, 104 and 106. The bottom layer 106 possesses non-skid properties so that seat step 100 does not slide laterally with respect to the seat surface (S) of the boat. The void 108 is defined within the perimeter of the center layer 104 and the stiffening sheet 110 is disposed inside of the void. The top layer 102 closes off the cavity above the stiffening sheet 110. The seat step can also comprise more than three layers.

Figure 5A:
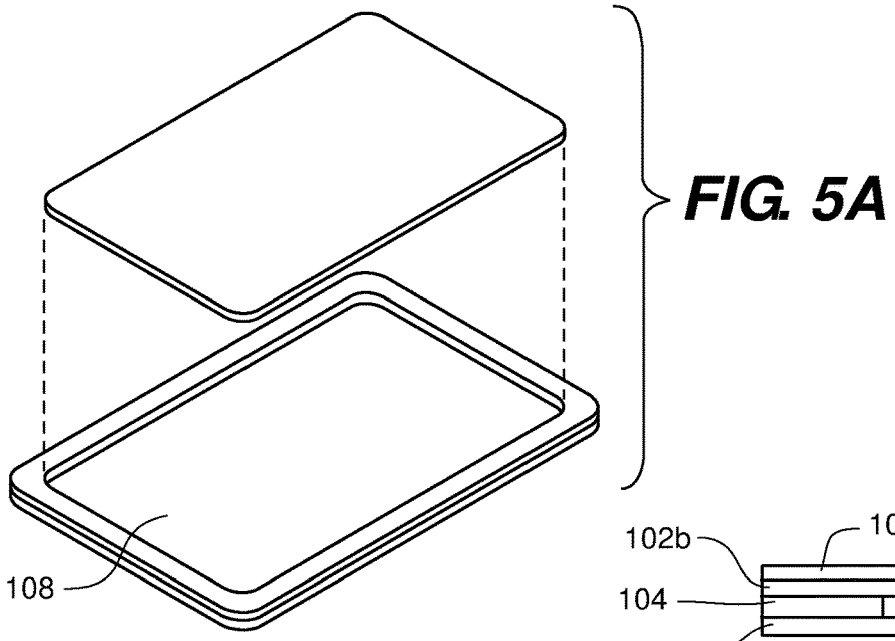
FIG. 5A is a perspective assembly view of a seat step in accordance with certain embodiments.
Figure 5B:
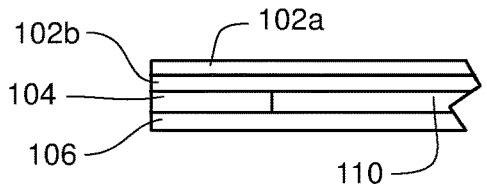
FIG. 5B is a side cross-sectional view of a portion of the seat step of FIG. 5A.

One or more of each of the flexible layers 102, 104 and 106 can be formed of multiple sub-layers. For example, top layer 102 can be formed as two separate sub-layers 102*a* and 102*b* such as is illustrated in FIG. 5B. Each of the top sub-layers 102*a*, 102*b* can be different colors, or can be the same color. If two different colors are provided, a CNC machine (or other manufacturing means) can be used to remove some of the uppermost top sub-layer 102*a* to expose the contrasting color sub-layer 102*b* below. This process can be used to define patterns or ridges or channels 112 of contrasting color (e.g., FIGS. 7-8 and 13) in the top layer 102 that can increase traction and reduce slipping as well as provide visual attractiveness, branding, etc. These defined patterns of channels 112 can also define logos and brand identifiers. Additional decoration, labeling, graphics and/or text can be added atop the uppermost top sub-layer 102*a* using other techniques such as laser etching, screen-printing or pad printing, etc.

An aspect of certain embodiments is the monolithic nature of the finished seat step 100 device. The monolithic characteristic is provided by each layer of the multiple layers being bonded together with a permanent adhesive. The layers then function together as a monolith in that they are no longer independent; they all act together as one single member. This feature allows the set step device 100 to be formed with a relatively thin overall thickness because the sum of the combined layers functioning monolithically is greater than the individual characteristics of the individual layers acting independently.

The monolithic body provides a transition from its stiff center structure to an intentional and controlled flexible outer edge portion (perimeter P in FIG. 10) to protect the seat cushions from being in contact with an otherwise stiff and potentially harsh edge. In other words, the differences in lateral width dimension between the embedded stiff sheet material 110 and the flexible material layers 102, 104, 106 create a controlled flex pattern/point as the monolithic body transitions from the stiff center embedded area outwardly to the controlled variable flex perimeter portion P created by the outer flexible layers laterally beyond the stiff sheet area.

Further control of the intentional flex perimeter is achieved by defining relief grooves 116 in the top surface that act as a living hinge where the distance from the body's outer edge and the distance from the edge of the embedded stiff material can change the flex curve/pattern of the outer transitional from a monolithic stiff body to a flexible edge so that it will not have a harsh edge around the perimeter that can dig in or damage over time the seat cushion's soft compressible structure.

In another aspect of certain embodiments, the seat step 100 is configured to have a horizontal mismatch/offset between the inner stiff membrane 110 and the surrounding flexible material layers 102, 104 and 106. This offset creates a controlled condition where, based on the offset of the stiff inner sheet 110 and the distance to the outer edge of the flexible layers 102, 104 and 106, the outer perimeter portion of the seat step 100 will have a flexible outer edge 114 to reduce unnecessary pressure on the seat cushion on the edge of the seat step 100 (see FIGS. 1, 11, 12A and 12B). The seat step 100 therefore more evenly distributes concentrations of weight on a small area, such as when a person is standing on the seat step 100. The controlled flex edge 114 gradually distributes weight of the user pressing down through the seat step 100 outward to where the seat step device laterally ends.

The stiffening sheet 110 has a different durometer and has different flex characteristics as compared the adjacent layers of material 102, 106. This results in the edge of the internal stiffening sheet 110 producing concentrations of force at the intersection where the different materials meet. In order to minimize wear of the edges of the stiffening sheet 110 on the adjacent flexible material, the stiffening sheet 110 can define radius corners as one views the sheet from above (top plan view—FIG. 10). In addition, the edges of the stiffening sheet 110 in side elevation view can be broken edge or radiused.

Figure 11:
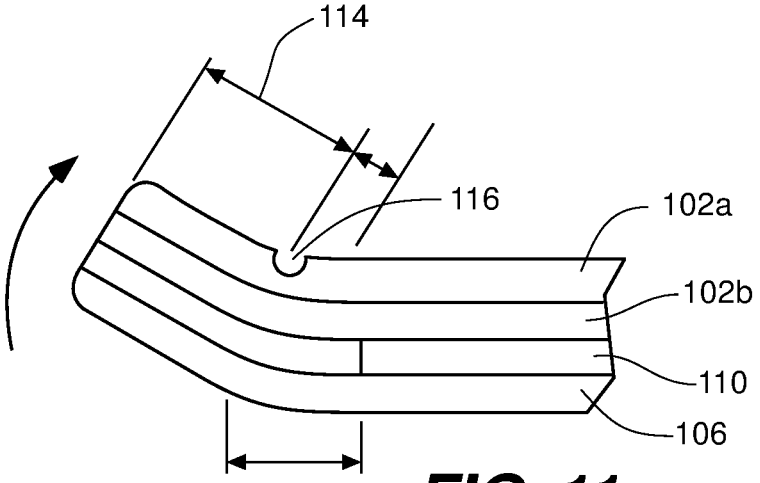
FIG. 11 is a side cross-sectional view of a portion of a seat step in accordance with certain embodiments.
Figure 12A:
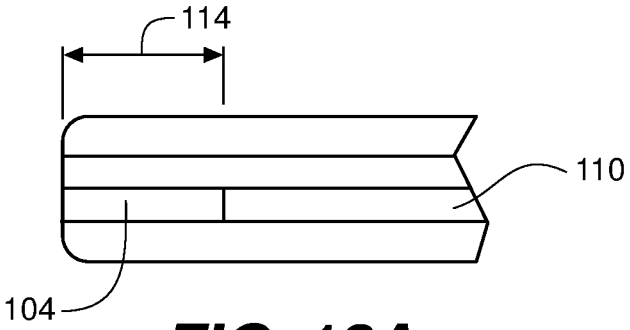
FIGS. 12A and 12B are side cross-sectional views of a portion of a seat step in accordance with certain embodiments.
Figure 12B:
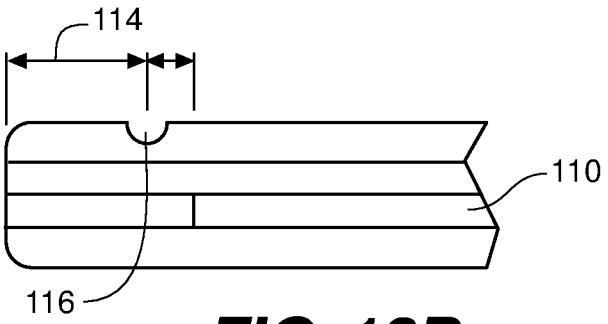
Figure 13:
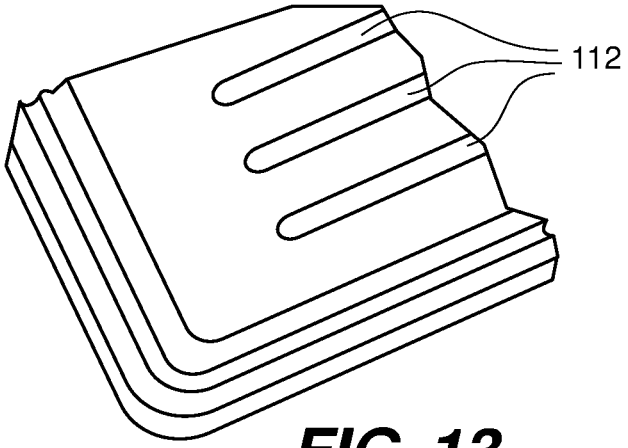
FIG. 13 is a perspective view of a portion of a seat step in accordance with certain embodiments.
Figure 14A:
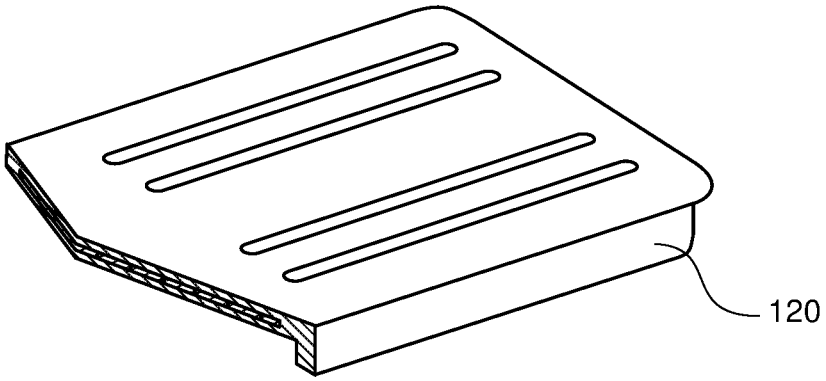
FIGS. 14A and 14B are perspective cross-sectional views of a portion of a seat step in accordance with certain embodiments.
Figure 14B:
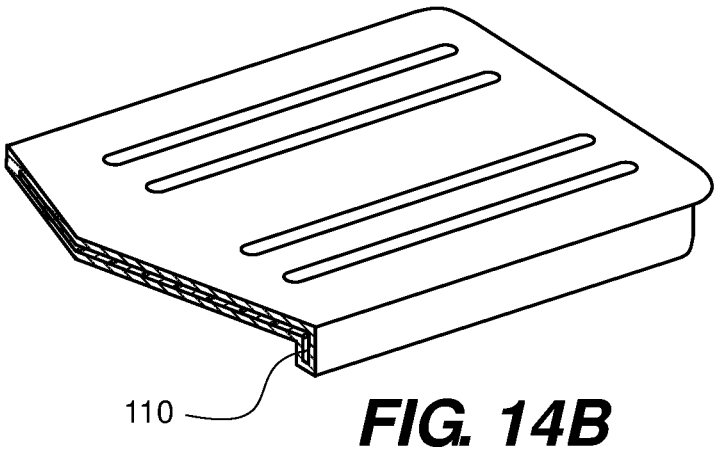

In a further aspect, the flexibility of the flex edge 114 can be further defined by positioning the relief groove 116 at a set distance inward offset from the outer horizontal edge of the seat step 100 to the outer horizontal edge of the inner stiffening sheet 110 (see FIGS. 11 and 12B). This relief or flex groove 116 is cut into the top layer 102 of material. The relative distance that this groove is laterally offset from the seat step 100 lateral outer edge and the lateral edge of the stiffening sheet 110 will force the device to bend with a specific force application and at a specific location similar to a living hinge.

The seat step 100 can also comprise more than one stiffening sheet 110. For example a second stiffening sheet can be provided within a layer adjacent to the first stiffening sheet. The second stiffening sheet can be identical to athe first stiffening sheet or it can have different flex properties, a different shape, a different size and/or a different placement within the layer as compared to the first stiffening sheet. One or more of the layers can also include two or more separate stiffening sheets. Additional layers comprising additional stiffening sheets can also be provided in further embodiments.

Weights can be disposed in one or more of the layers of the seat step 100 to ensure that the seat step has sufficient weight to reduce the likelihood that the seat step will become airborne while the boat is in motion.

The seat step 100 in certain embodiments is portable and designed with purposeful intent to distribute weight and manage the outer perimeter flexibility to minimize stretching of the upholstery and cushion's construction of the boat's seat. The seat step 100 can include a non-slip property of the bottom material layer and/or a texture on a bottom-most surface to reduce slippage against the seat. The top surface of the seat step can be provided with grooves and designs to intentionally displace any water that drips from the users' swimsuit to keep a dry contact surface underfoot. The seat step also can be formed with a very rigid bending characteristic with a thin profile. The seat step also easily allows for the provision of branding with logos. The channels defined in the top surface can also collect and disburse moisture and water.

The thin profile reduces the visual impact of the device and minimizes the likelihood of catching toes and tripping the user.

The seat step device 100 can be used in a variety of applications other than boat seats. It can be used on the boat (back deck pad), on the dock, in a recreational vehicle, on shore, etc. The seat step transfers easily, stores easily and is portable from one location to another.

The inner stiffening sheet 110 can be pre-loaded so that its natural state has an upward 3-dimensional neutral position or curvature prior to a vertical force being put on it.

The seat step can be formed in any desired size or shape, such as for example, square, rectangle, circular, semicircular, polygonal or complex shapes.

Figure 4:
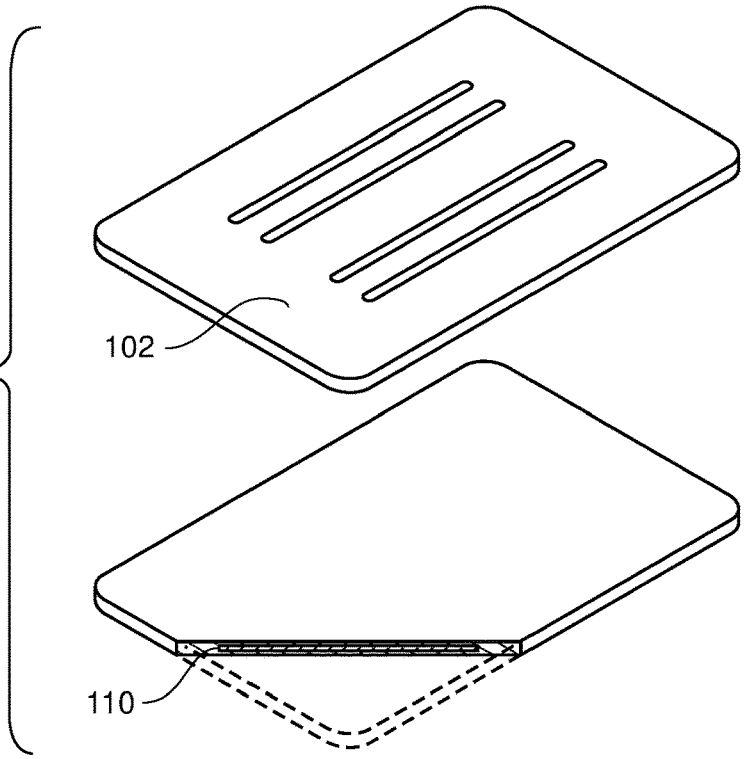
FIG. 4 is a perspective assembly view of a seat step in accordance with certain embodiments.

In a further alternative, referring to FIG. 4, the flexible outer material 102 can be over-molded over the stiffening sheet 110. The molding process can be a single process or multiple stage process or cycle to make a finished monolithic component. A combination of forming techniques can also be employed, such as over molding combined with a lamination of one or more of the layers to the over molded component.

Referring to FIGS. 1-3B, in use, the user places the seat step 100 atop the seat area (S) that will be used as a step. The user then steps on the top surface (layer 102) of the seat step 100 with their feet. As noted in FIGS. 1 and 3A-3B, the seat step 100 can be placed such that it bridges across gaps between adjacent seat cushions of the boat.

Figure 6:
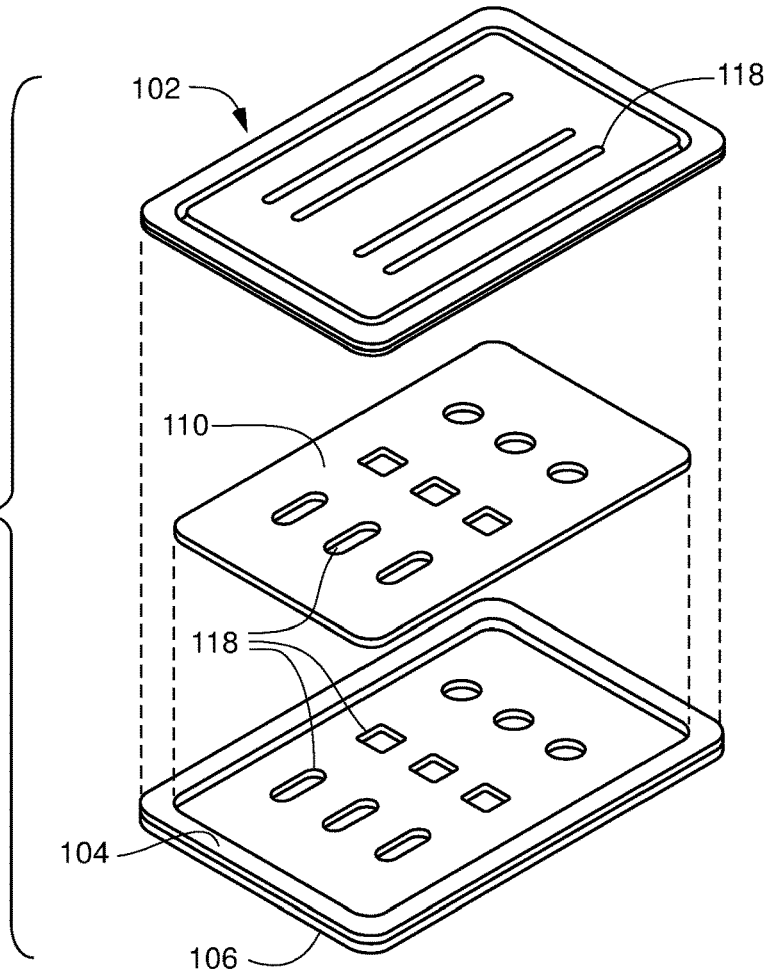
FIG. 6 is a perspective assembly view of a seat step in accordance with certain embodiments.
Figure 7:
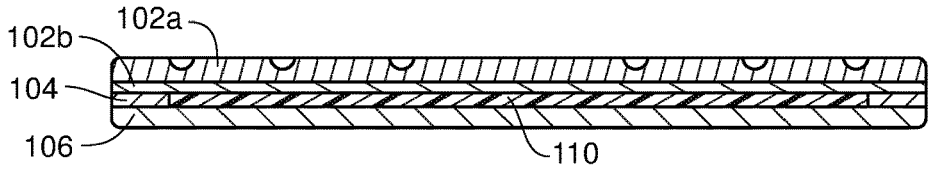
FIG. 7 is a side cross-sectional view of a seat step in accordance with certain embodiments.
Figure 8:
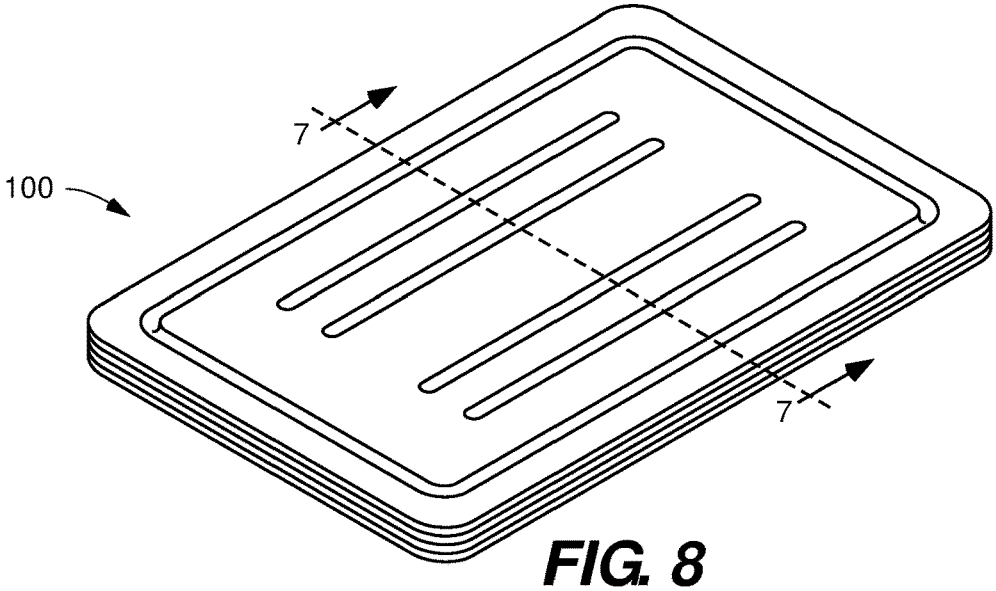
FIG. 8 is a perspective view of a seat step in accordance with certain embodiments.
Figure 9:
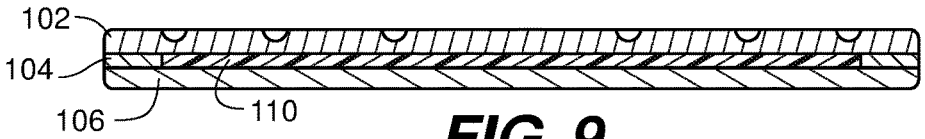
FIG. 9 is a side cross-sectional view of the seat step of FIG. 8.
Figure 10:
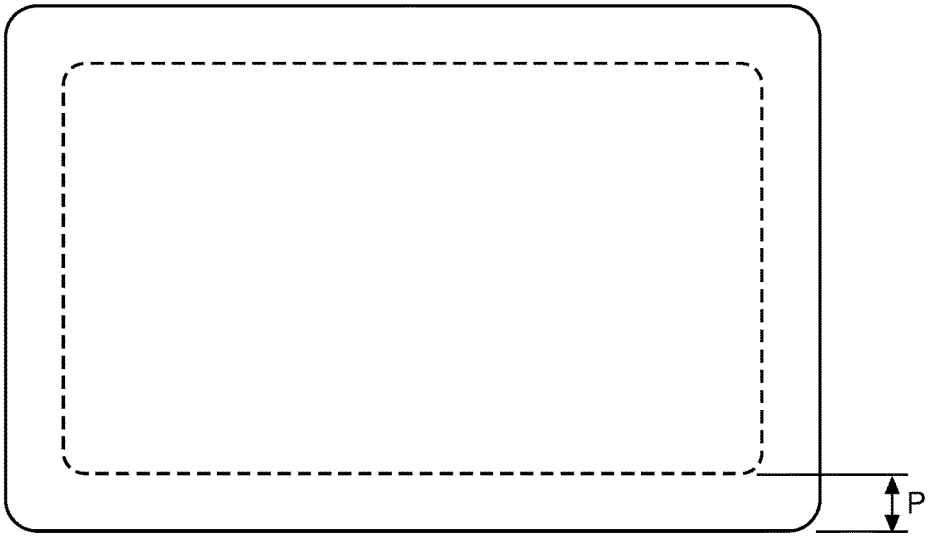
FIG. 10 is a top view of a seat step in accordance with certain embodiments.

Referring to FIG. 6, a plurality of holes or apertures 118 can be formed through each of the layers of the seat step 100 so that water can more easily drain through the device. The apertures 118 also allow air to vent through the device so that water atop the boat seat can dissipate. In FIG. 6, the apertures 118 in the top layer 102 are in the form of channels or grooves. Alternatively, or in addition to, apertures can be formed horizontally into or through the seat step.

Referring to FIGS. 14A-15C, one or more lateral sides of the seat step 100 can define a vertical extension portion 120 that extends downward from the horizontal plane of the seat step. The downward extension extent is greater than the thickness of the main planar portion. The downward extension portion 120 can include the stiffener sheet 110 or can include a separate stiffener component. The downward extension 120 can be provided on any one or more of the front, back and lateral sides of the main planar body portion. If multiple downward extensions 120 are provided, any one or more can include the stiffener component.

Figure 15A:
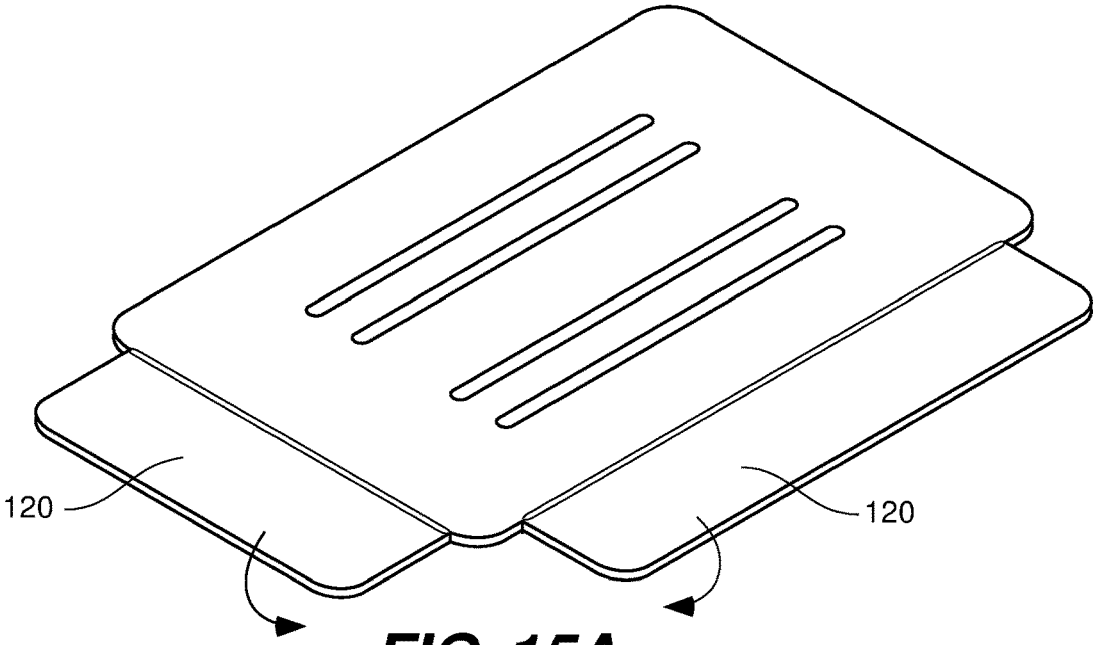
FIGS. 15A, 15B and 15C are perspective views of a seat step in accordance with certain embodiments.
Figure 15B:
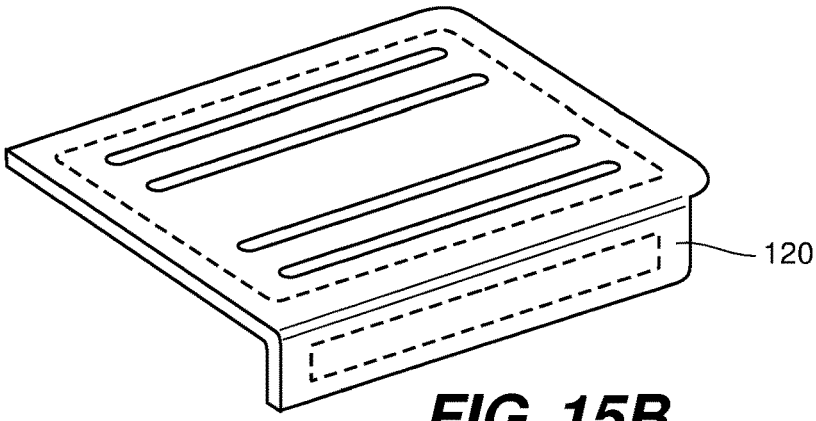
Figure 15C:
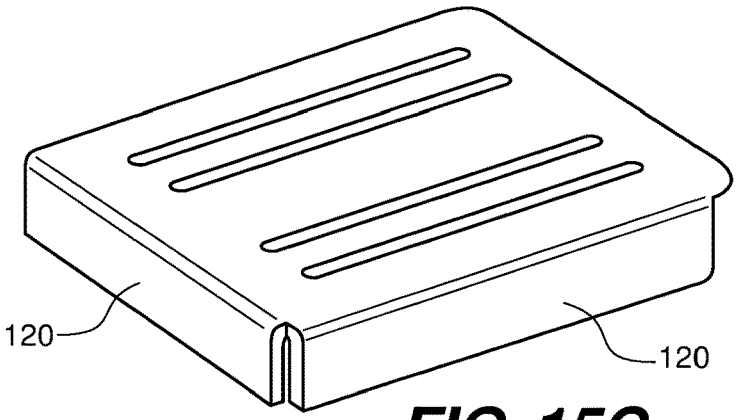

The downward extension portion 120 can also be formed flexible such that it can pivot as indicated in FIG. 15A.

Figure 16A:
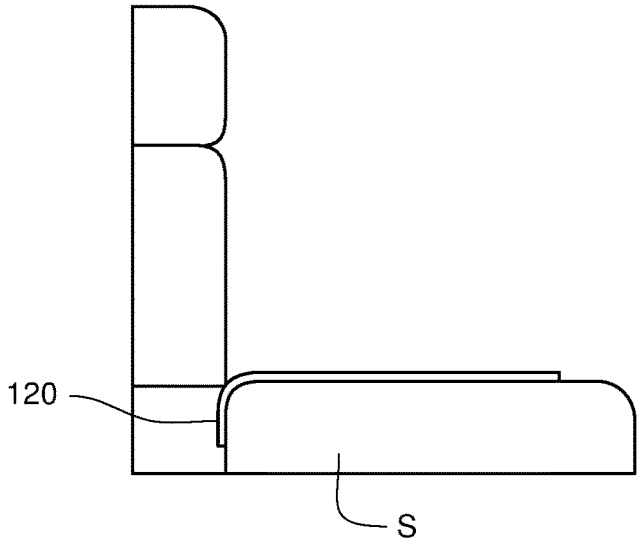
FIGS. 16A, 16B and 16C are side views of a seat step in accordance with certain embodiments.
Figure 16B:
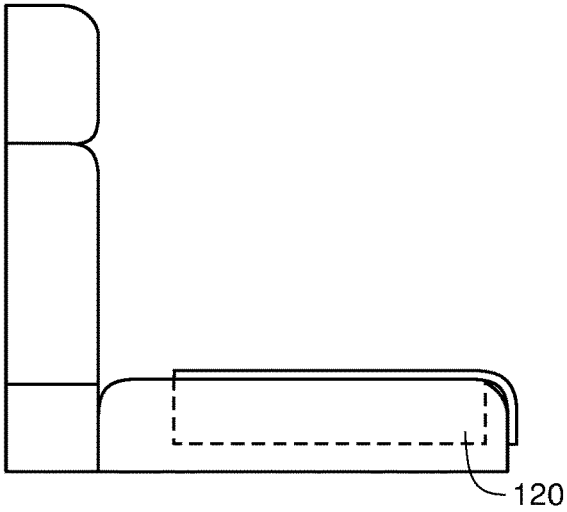
Figure 16C:
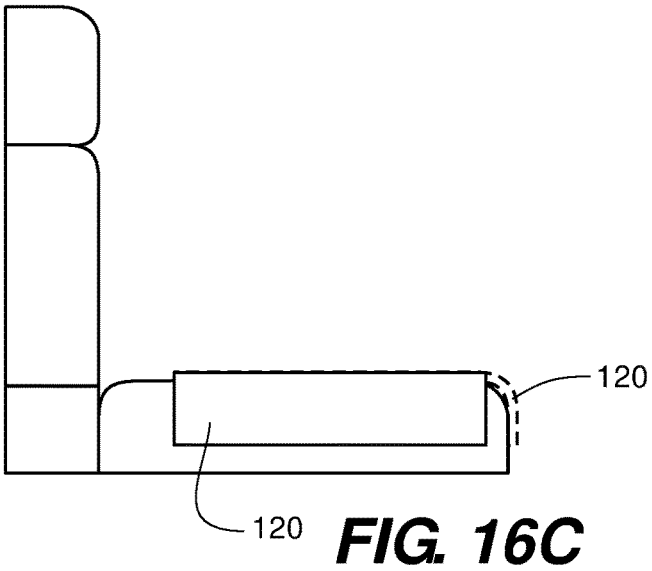

As can be seen in FIGS. 16A-16C, the downward extension portion 120 can be used to secure the seat step 100 with respect to the boat seat (S) or to better protect the boat seat cushion.

Figure 17:
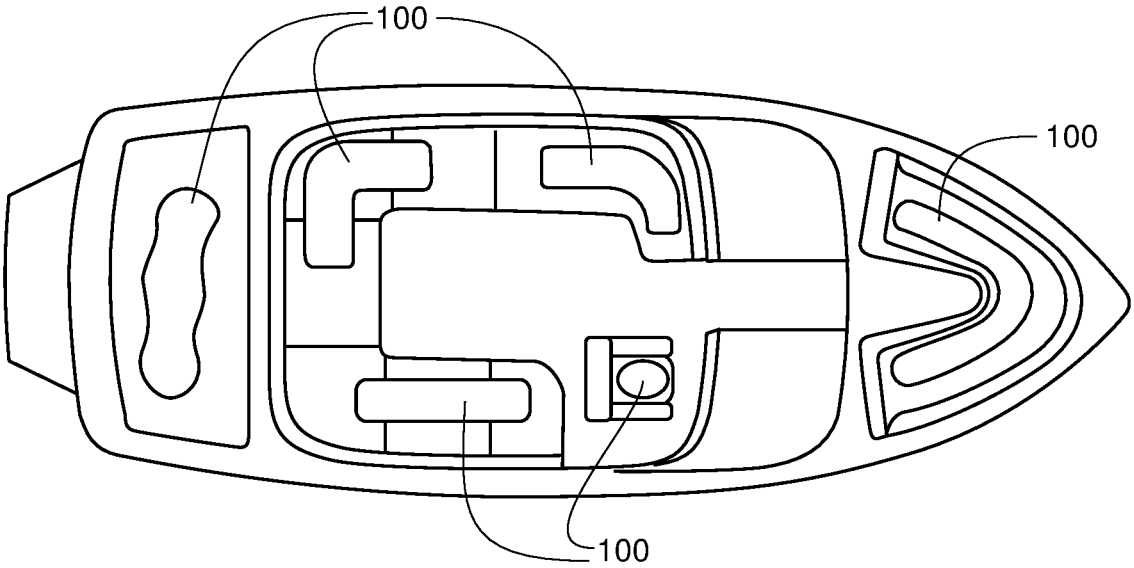
FIG. 17 is a top plan view of several seat steps atop boat seats in accordance with certain embodiments.

Referring to FIG. 17, the seat step 100 can be configured in many different shapes and sizes. For example, the seat step 100 can be configured in an "L" shape to accommodate a corner seat, or in a "V" or "U" shape to accommodate an open bow, or other shapes to conform to other interior seat configurations, or can be a random shape or a custom shape chosen for aesthetic purposes.

While the invention has been described in connection with what is presently considered to be the most practical and preferred example embodiments, it will be apparent to those of ordinary skill in the art that the invention is not to be limited to the disclosed example embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A portable step, comprising:

a first layer of flexible material;

a second layer of flexible material; and a third layer disposed vertically atop the first layer and vertically below the second layer, the third layer comprising a rigid sheet and a perimeter of flexible material that surrounds the entirety of a horizontal perimeter of the rigid sheet.

2. The portable step of claim 1, wherein the first, second and third layers are all horizontally co-extensive such that the portable step defines a horizontally-extending planar body.

3. The portable step of claim 1, wherein the first and second layers are formed of a material that causes the portable step to float on water.

4. The portable step of claim 1, wherein a waterproof adhesive joins the first layer to the third layer and the second layer to the third layer.

5. The portable step of claim 1, wherein the first layer on a side thereof opposite the third layer has a non-skid property.

6. The portable step of claim 1, wherein the first layer comprises a first sub-layer and a second sub-layer, wherein the first sub-layer faces opposite the second layer, and wherein the first sublayer defines a plurality of channels therein to reveal the second sub-layer where the plurality of channels are formed.

7. The portable step of claim 6, wherein the second sub-layer is a different color than the first sub-layer.

8. The portable step of claim 1, wherein a relief groove is defined in the first layer vertically above the perimeter of flexible material of the third layer.

9. The portable step of claim 1, wherein the rigid sheet defines radiused corners.

10. The portable step of claim 1, wherein the first layer on a side thereof opposite the third layer is textured.

11. The portable step of claim 1, wherein the rigid sheet is pre-loaded such that in an unladen state the rigid sheet defines a vertically-upward curvature.

12. The portable step of claim 1, wherein, in top view, the portable step defines a polygon shape.

13. The portable step of claim 1, wherein a plurality of apertures are defined through each of the first, second and third layers of the portable step such that water introduced to a top surface of the portable step can drain vertically through the plurality of apertures.

14. The portable step of claim 1, wherein at least one horizontal side of the portable step comprises a vertical extension portion.

15. The portable step of claim 14, wherein the vertical extension portion comprises an internal stiffener.

16. The portable step of claim 14, wherein the vertical extension portion is pivotable with respect to the first, second and third layers.

* * * * *